United States Patent [19]

About

[11] Patent Number: 4,909,384

[45] Date of Patent: Mar. 20, 1990

[54] BOX-LIKE CONTAINER INCLUDING AT LEAST ONE POSITIONALLY ADJUSTABLE PARTITION

[76] Inventor: Julien E. About, 11, rue du Faubourg Saint-Martin, 75010 Paris, France

[21] Appl. No.: 231,412

[22] Filed: Aug. 12, 1988

[30] Foreign Application Priority Data

Aug. 12, 1987 [FR] France ..... 87 11452

[51] Int. Cl.[4] ..... A47K 5/08

[52] U.S. Cl. ..... 206/77.1; 206/561; 220/22.1; 220/22.3

[58] Field of Search ..... 206/77.1, 561, 557; 220/22.1, 22.3, 22.5; 312/350

[56] References Cited

U.S. PATENT DOCUMENTS

| | | | |
|---|---|---|---|
| 1,575,021 | 3/1926 | Van Vlissingen | 220/22.1 |
| 1,928,512 | 9/1933 | Swift | 206/561 |
| 2,042,167 | 5/1936 | Beeler | 220/22.3 |
| 2,368,349 | 1/1945 | Cornish | 220/22.1 |
| 2,855,936 | 10/1958 | Aamodt | 220/22.1 |
| 3,318,454 | 5/1967 | Donlin . | |
| 4,358,035 | 11/1982 | Heidecker | 220/22.1 |
| 4,405,057 | 9/1983 | Stein . | |

FOREIGN PATENT DOCUMENTS

| | | | |
|---|---|---|---|
| 676791 | 3/1966 | Belgium . | |
| 1429531 | 11/1969 | Fed. Rep. of Germany . | |
| 1529367 | 6/1968 | France . | |
| 226235 | 3/1943 | Switzerland | 220/22.1 |

*Primary Examiner*—David T. Fidei
*Attorney, Agent, or Firm*—William R. Hinds

[57] ABSTRACT

The invention relates to a container of the kind including at least one partition (6) and comprising at least one bottom (4) and peripheral side walls (5). The container is characterized in that the partition is positionally adjustable and has at least one pin (8), comprising a rod (10) terminating at its free end in an enlarged head, on the lower edge (9) of the partition, and that the bottom (4) has at least one elongated window (7) for receiving the rod and retaining the head. The window (7) has at least one enlargement (12) to allow the passage of the enlarged head. The invention is applicable to a box-like dish that can initially be used as a soap dish, for example, and later for other use.

11 Claims, 2 Drawing Sheets

BOX-LIKE CONTAINER INCLUDING AT LEAST ONE POSITIONALLY ADJUSTABLE PARTITION

FIELD OF THE INVENTION

The present invention relates to a box-like container including at least one positionally adjustable partition, to make a compartmented tray. More particularly, it relates to a container of this type intended for use as a soap dish.

FEATURES AND ASPECTS OF THE INVENTION

The object of the invention is to provide a container of the above type in which the partition can be displaced and adjusted at a new position as needed so as to vary the relative size of the compartments and adapt that size to the size of the item or items placed in the dish.

To this end, the container according to the invention is a dish-type composite container with a double bottom, comprising an inner dish having at least one partition and bottom and peripheral side walls, wherein the partition is positionally adjustable and on a lower edge of the partition, facing the dish bottom, has at least one mounting and retaining pin comprising a rod terminating at a free end in an enlarged head, and wherein for receiving and retaining the partition with the pin, the dish bottom has at least one elongated window, opening to the upper surface of the dish bottom for receiving the rod and retaining the enlarged head, the window having at least one enlargement also opening to the upper surface of the dish bottom to allow the passage of the head, the entire apparatus being such that the partition, after the partition is mounted on the dish bottom by penetration of the enlarged head and rod in the enlargement, can be adjusted in position by sliding of the pin in the window, the partition being retained by the enlarged head, the upper surface of which, on at least one side of the window, faces a lower surface of the dish bottom bordering the window, the dish being housed in an outer envelope having at least peripheral side walls and a bottom wall, the bottom of the dish being located above and spaced apart from the bottom wall of the envelope so as to form a composite compartmented dish-type container with a hollow space beneath the bottom of said dish.

Generally, for assuring good guidance of the partition, there are at least two parallel windows, preferably longitudinal, and the partition correspondingly includes at least two pins, spaced apart by the distance between the windows.

In a first mode of cooperation between the partition and the bottom, the window completely crosses the bottom over the same width, the head of the pin cooperating with its upper surface with the lower surface of the bottom with respect to which it projects.

In a second mode of cooperation, the window again completely crosses the bottom, but it has a stepped cross section, for defining an upper narrow portion to allow the passage of the rod and a lower wide portion to allow the passage of the head, the bottom having a thickness not less than the height of the pin, such that the head of the pin will not protrude past the lower surface of the bottom.

In a third mode of cooperation, the window opens toward the bottom into a wide blind (closed-end) cavity, to allow the passage of the head, made in the thickness of the bottom.

In the last two modes for cooperation, the width of the wide lower portion and/or of the blind cavity is substantially equal to that of the enlargement.

To comprise a soap dish, the dish as described above has a pierced bottom, in the manner of a grate or drainer, and is accommodated in the outer envelope. The dish advantageously has an upper peripheral rim that projects downward toward the outside and is intended for cooperation with the edges of the envelope.

Nevertheless, whatever the intended application, the dish may have at least one foot that projects below the level of the bottom, to allow the dish to rest on its support.

In a particular embodiment of the pin, the rod comprises a rib located in a plane perpendicular to the partition and increasing in size toward the bottom, for connection with the enlarged head. This rib has the dual role of guiding the pin in the window and lending rigidity to the pin.

The invention will be better understood from the ensuing detailed description, taken in conjunction with the accompanying drawings.

DESCRIPTION OF THE PREFERRED EMBODIMENTS

Figure 1:
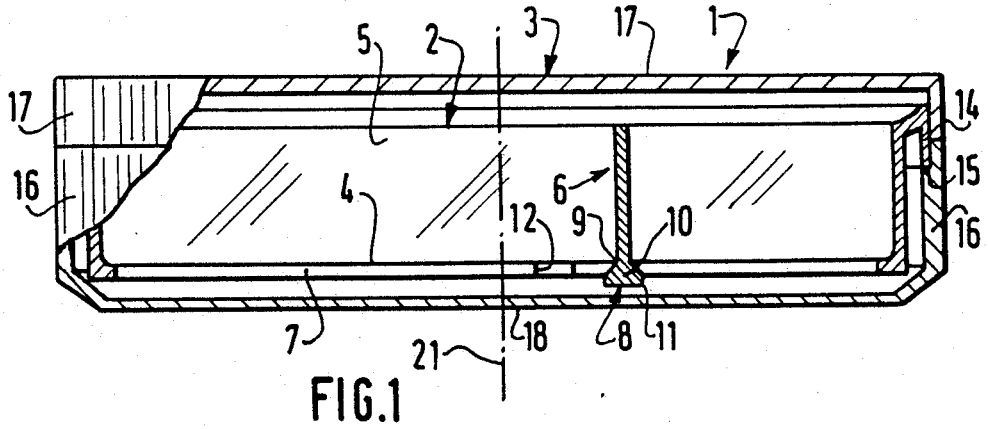
FIG. 1 is a longitudinal vertical section, partially cut away, of a soap dish made in accordance with a preferred embodiment of the invention.
Figure 2:
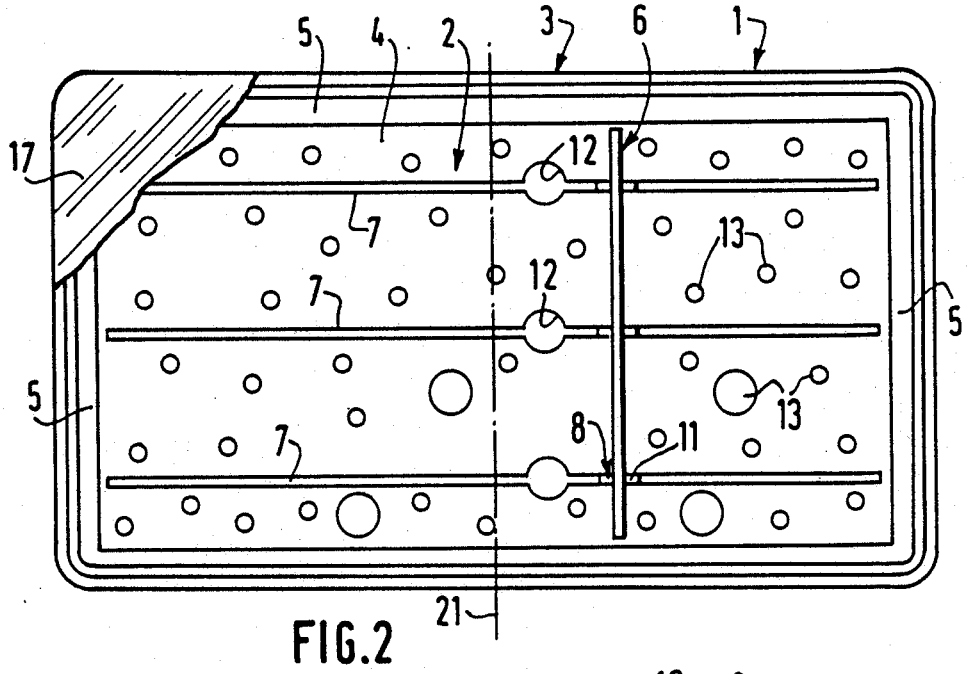
FIG. 2 is a plan view, partially cut away, of the dish of FIG. 1.
Figure 3:
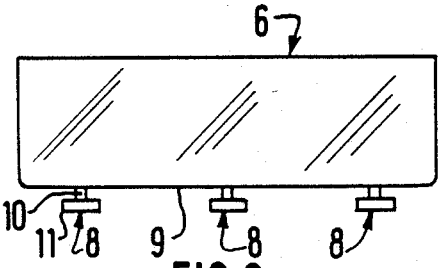
FIG. 3 is a lateral elevation view of a partition of the dish of FIGS. 1 and 2.
Figure 4:
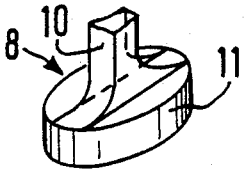
FIG. 4 is a perspective view of a first variant of the pin provided on the lower edge of the partition.

First, a preferred embodiment of the container according to the invention will be described, in its use as a soap dish, referring to FIGS. 1–4.

The container 1 is a composite container, comprising an inner dish 2 and an outer envelope 3. The inner dish 2 includes a bottom 4 and four peripheral side walls 5 that are perpendicular to the bottom and with this bottom define a parallelepiped volume. At least one partition 6 is provided to divide the inside volume of the dish 2 into at least two compartments. Generally, the partition 6 is perpendicular to the bottom 4 and extends transversely. For receiving and retaining the partition 6, the bottom 4 has at least one elongated window 7 that opens to the upper surface of the bottom and extends longitudinally between the two corresponding walls 5 or at least from close to one of these two walls to close to the other of these two walls. Generally, there are at least two windows 7, and in the embodiment shown, the wall 4 includes 3 windows 7.

Each window 7 is intended to cooperate with a pin 8 which is provided on the lower edge 9 of the partition 6 and comprises a connecting rod 10 terminated at its free end by an enlarged head 11. The rod 10 has a width very slightly less than that of the window 7, while in a direction transverse to the partition 6, that is, parallel to the window 7, the rod 10 is in the form of a generally triangular rib, which assures good guidance of the partition and makes the pin 8 strong.

Figure 10:
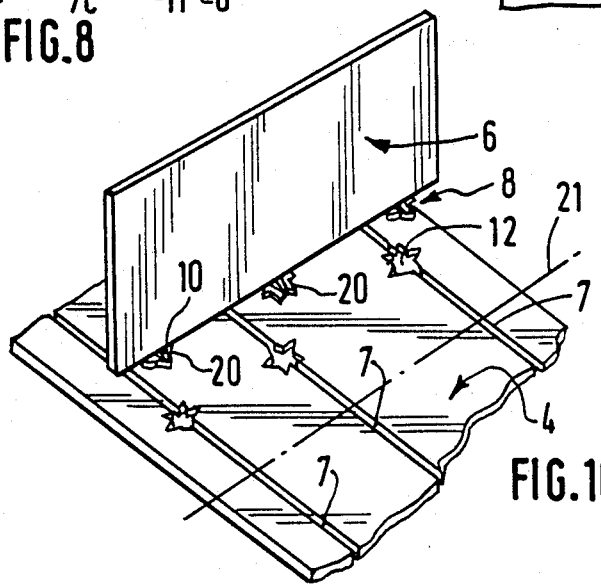
FIG. 10 is a perspective view of the partition provided with pins of star-shaped cross section.

The enlarged head 11 is of circular cross section, for example, as shown in FIGS. 1–4. As a variant, it may have any suitable form, for example a star 20, as shown in FIG. 10. In a corresponding and complementary fashion, the window 7 has at least one enlargement 12 also opening onto the upper surface of the bottom 4, to allow the passage of the head 11. In the case where there are at least two windows 7, the enlargements 12 are transversely aligned. Advantageously, the transversal line passing through the centers of the enlargements 12 is clearly remote from the transverse median plane 21 of the dish, such that one of the adjusted positions of the partition 6 can coincide precisely with this median plane 21.

In the embodiment of FIGS. 1–4, the height of the rod 10 is substantially equal to the thickness of the bottom 4, and each window 7 completely crosses the bottom of the dish, having a uniform width, such that the head 11 of the pin 8 cooperates, at its upper surface, with the lower surface of the bottom from which it projects.

For the emplacement of the partition 6, the pins 8 are placed facing the enlargements 12, inside the dish 2; then the partition is lowered against the bottom 4, so that the pins 8 cross these enlargements, and the heads 11 assume a position beneath the level of the bottom 4. The partition can now be displaced longitudinally along the windows 7, to define two compartments.

As needed, the partition 6 may be retained by friction, or by two longitudinal side walls 5, or by a slight pinching of the bottom 4 between the lower edge 9 of the partition and the enlarged heads 11, or it may be received with sufficient play as to be capable of sliding freely.

In the particular application intended here, the bottom 4 is pierced, and to this end it has perforations 13 to make a grate or drainer. One compartment is now intended for receiving a bar of soap, while the other compartment is intended to receive one or more labels relating to the composition of the soap and providing instructions for use.

Figure 5:
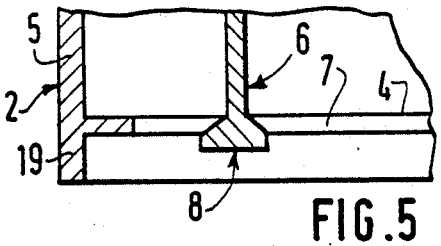
FIG. 5 is a longitudinal section through a portion of a dish made in accordance with a variant embodiment.

The inner dish 2 has an upper peripheral rim 14 projecting downward toward the outside, intended for cooperation with a rabbet 15 made on the upper edge of a tray 16 that is part of the envelope 3. The tray 16 is closed by a lid 17 retained by friction by the upper edge of the rim 14 protruding from the tray 16. The depth of the tray 16 is determined such that the bottom of the inner dish 2 will be spaced apart from the bottom 18 of the tray. In the variant embodiment of FIG. 5, the dish 2 has at least one foot 19 that projects below the level of the bottom 4, to permit the dish 2 to rest on its support without the risk that the heads of the pin 8 will interfere with this support. The foot 19 may for example be an unbroken base extending around the edge.

Figure 6:
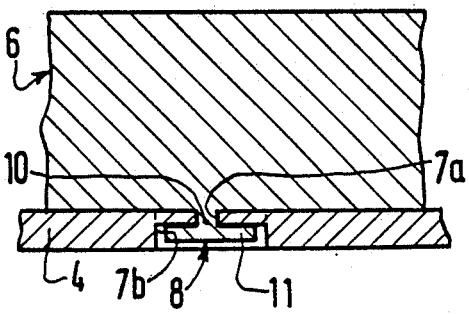
FIG. 6 is a cross section in the plane of the partition of a dish made in accordance with another variant embodiment.
Figure 7:
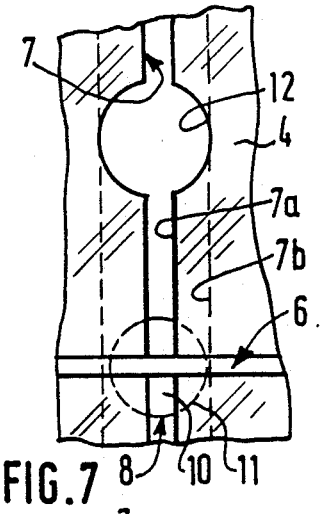
FIG. 7 is a plan view of the dish of FIG. 6.

In the variant of FIGS. 6 and 7, the window 7 completely crosses the bottom 4 as before, but it has a stepped cross section for defining a narrow upper portion 7*a* to allow the passage of the rod 10 and a wide lower portion 7*b* to allow the passage of the head 11, the bottom 4 having a thickness which is not less than the height of the pin 8, such that the head 11 will not project beyond the lower surface of the bottom 4. In this case, the foot 19 of FIG. 5 can be dispensed with.

Figure 8:
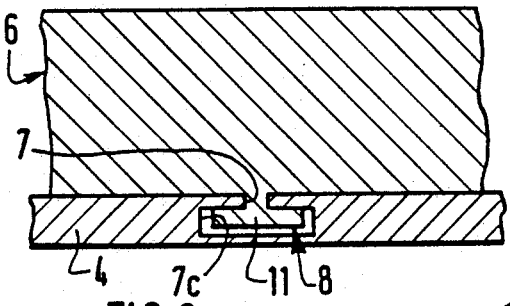
FIG. 8 is a view similar to FIG. 6 and again relating to another variant embodiment.
Figure 9:
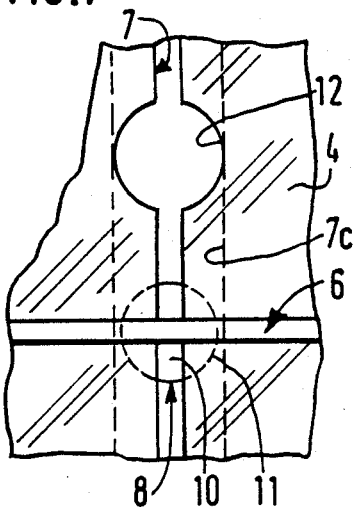
FIG. 9 is a plan view of the dish of FIG. 8.

In the variant embodiment of FIGS. 8 and 9, the window 7 opens toward the bottom into a wide blind cavity 7*c* made in the thickness of the bottom 4 for receiving and allowing passage of the head 11 of the pin 8. In this case, once again, the foot 19 of FIG. 5 can be dispensed with.

In the two variant embodiments of FIGS. 6–9, the width of the lower portion 7*b* of the window 7 and the width of the blind cavity 7*c* are substantially equal to that of the enlargement 12, as shown in FIGS. 7 and 9.

It will be understood that the invention is not limited to the embodiments or application described above; on the contrary, variant embodiments are possible without departing from the scope of the invention. For instance, the dish 2 could be used without its outer envelope 3. Equally, after its initial use, the dish alone or the composite container including the dish may find other uses later, when it may be used to hold playing cards, cigarettes, stamps, coins, or tickets, for example. Advantageously, the outer envelope will be provided with a luxurious appearance.

I claim:

1. A dish-type composite container with a double bottom, comprising an inner dish having at least one partition (6) and bottom (4) and peripheral side walls (5), characterized in that the partition (6) is positionally adjustable and on a lower edge (9) of the partition, facing the dish bottom (4), has at least one mounting and retaining pin (8) comprising a rod (10) terminating at a free end in an enlarged head (11), and in that for receiving and retaining the partition (6) with the pin (8), the dish bottom (4) has at least one elongated window (7), opening to the upper surface of the dish bottom for receiving the rod and retaining the enlarged head, the window having at least one enlargement (12) also opening to the upper surface of the dish bottom to allow the passage of the head (11), the entire apparatus being such that the partition (6), after the partition is mounted on the dish bottom (4) by penetration of the enlarged head (11) and rod (10) in the enlargement (12), can be adjusted in position by sliding of the pin (8) in the window (7), the partition being retained by the enlarged head, the upper surface of which, on at least one side of the window, faces a lower surface of the dish bottom bordering the window, the dish being housed in an outer envelope having at least peripheral side walls and a bottom wall, the bottom of the dish being located above and spaced apart from the bottom wall of the envelope so as to form a composite compartmented dish-type container with a hollow space beneath the bottom of said dish.

2. A container as defined by claim 1, characterized in that at least two parallel windows (7) are present, the partition (6) including at least two pins (8) spaced apart by the distance between said two windows.

3. A container as defined by claim 1, characterized in that the rod (10) comprises a rib located in a plane perpendicular to the partition and increasing in size toward the bottom for connection with the enlarged head (11).

4. A container as defined by claim 1, characterized in that the window (7) completely crosses the bottom (4) over the same width, the head (11) of the pin (8) cooperating, with its upper surface, with the lower surface of the bottom, from which the head (11) projects.

5. A container as defined by claim 1, characterized in that the window (7) completely crosses the bottom (4) and has a stepped cross section, for defining an upper narrow portion (*7a*) to allow the passage of the rod (10) and a lower wide portion (*7b*) to allow the passage of the head (11), the bottom (4) having a thickness not less than the height of the pin (8), so that the head will not project past the lower surface of the bottom.

6. A container as defined by claim 1, characterized in that the window (7) opens toward the bottom into a wide closed-end cavity (*7c*), to allow the passage of the head (11), which cavity is made in the thickness of the bottom (4).

7. A container as defined by claim 5, characterized in that the width of said lower wide portion (*7b*) is substantially equal to that of said enlargement (12).

8. A container as defined by claim 1, characterized in that at least one wall of the dish has a downwardly projecting upper peripheral rim (14) toward the outside, which rim is intended for cooperation with a groove formed on the upper edge of a wall of said envelope.

9. A container as defined by claim 1, characterized in that the dish has at least one foot (19) projecting beneath the level of said bottom of the dish.

10. A container as defined by claim 6 characterized in that the width of said wide closed-end cavity (*7c*) is substantially equal to that of said enlargement (12).

11. A container as defined by claim 1 wherein the bottom (4) of the inner dish (2) is pierced and has perforations (13) to comprise a drainer.

* * * * *